United States Patent [19]

Gutridge et al.

[11] 3,981,524

[45] Sept. 21, 1976

[54] ANTI-PILFERAGE LOCK FOR BOX CAR DOORS

[75] Inventors: Jack E. Gutridge, Dyer, Ind.; James J. Schuller, Crete, Ill.

[73] Assignee: Pullman Incorporated, Chicago, Ill.

[22] Filed: May 27, 1975

[21] Appl. No.: 581,193

[52] U.S. Cl. ..... 292/31; 292/DIG. 32

[51] Int. Cl.[2] ..... E05C 1/04

[58] Field of Search ..... 292/31, 189, 42, 281, 292/302, DIG. 32

[56] References Cited

UNITED STATES PATENTS

| | | | |
|---|---|---|---|
| 2,297,977 | 10/1942 | Osner | 292/DIG. 32 |
| 3,848,908 | 11/1974 | Rich | 292/189 |

*Primary Examiner*—Richard E. Moore
*Attorney, Agent, or Firm*—Richard J. Myers

[57] ABSTRACT

A railway box car side includes a door opening having a sliding door arrangement with a conventional hasp locking device provided at the lower portions of the door so as to be readily accessible to a person standing at track level. The door arrangement, which may be of a single or double door type, includes an anti-pilferage lock which is positioned near the upper ends of the doors so as to be relatively inaccessible except when the box car has arrived at a loading platform. The anti-pilferage lock includes a keeper positioned on one of the doors in a two door arrangement or the said keeper is positioned on the door post of the car opening in a single door arrangement. The keeper includes an outwardly projecting hook-shaped wall arrangement having a vertical recess. A latch support is positioned on one of the doors and includes a vertical guideway in which a latch device provided with an arm and slide member is slidingly positioned. The arm includes a hook-shaped end portion with a tongue slidingly engageable with a vertically extending recess provided in the keeper. The latch arm is movable from a lowered position vertically into locking position with respect to the keeper and is secured in said position by means of a conventional padlock or cable connected to locking tabs respectively provided on the latch member and keeper.

7 Claims, 3 Drawing Figures

ANTI-PILFERAGE LOCK FOR BOX CAR DOORS

A related patent application is Ser. No. 590,775 filed June 27, 1975.

BACKGROUND OF THE INVENTION

1. Field of the invention

The present invention relates to railway box car doors having conventional locking means therefore with said doors slideable to one side of a box car opening.

2. Description of the Prior Art

The prior art is exemplified in U.S. Pat. No. 3,788,007 patented Jan. 29, 1974. Doors of this type are slidingly disposed relative to a railway box car opening and the arrangement may consist of a single door or a pair of doors, the one being considered an aauxiliary. In either case the doors may be suitably interlocked by a conventional hasp and lock arrangement which is well known in the prior art. Such an arrangement permits the doors to be separated while one door remains in locked position relative to the frame and the other door is moved to an open position. The double door arrangement also includes another conventional hasp and lock arrangement which is connected to the auxiliary door and to the frame structure of the railway box car. Thus, the auxiliary door also may be maintained stationary in a locked position within one half of the door opening while the other door may be moved slidingly to an open position. The hasp locks of the conventional sliding doors are usually positioned at the lower ends thereof and are readily accessible to a person or operator who is standing at track level. These locks are so easily accessible that in many cases the doors are opened by unauthorized persons for theft and pilferage purposes. The present invention has to do with an anti-pilferage lock which is positioned at a distance high on the doors so as to be virtually inaccessible to a person standing on the ground but being readily unlockable when the box car is moved into a railway siding and adjacent to a loading platform. The improved lock also is constructed so as to be readily openable at the loading platform but being virtually inaccessible and particularly difficult to open in an unathorized manner when the box car is in over-the-road operation.

SUMMARY OF THE INVENTION

A double door arrangement includes a pair of sliding doors which are connected within a door opening by means of conventional hasp lock arrangements, the auxiliary door being releasably connected to one of the frames of the opening and the other door being in turn releasably connected by a conventional hasp lock to the first door. Anti-pilferage locks are positioned to connect the two doors together and these are located high enough on the doors so as to be relatively inaccessible to someone standing at track level. A single pilferage lock also is usable in connection with a single door opening wherein a portion of the lock is connected to the adjacent frame of the door opening and the other portion is connected to the single door. The present anti-pilferage lock includes a keeper which is positioned to the innermost vertical side frame member of the doors, the said keeper including an outwardly projecting wall which is substantially normal to the door sheathing. A second longitudinal extending wall portion of the keeper provides with the outwardly projecting wall a hook recess extending in a vertical direction. A slide support for a latch mechanism is rigidly secured to the other door and includes a vertically extending guideway. The guideway opens outwardly by means of a vertical slot. A latch element includes an arm which at one end is provided with an inwardly extending wall portion having the wall portion projecting through the vertical slot and including a slide member connected thereto which is vertically guided within the guideway. The arm also includes an overlapping end wall portion which overlaps the longitudinal wall of the keeper, the said end portion also including an inwardly extending tongue which extends into the vertical recess formed within the keeper. Both the keeper and the overlapping wall portion of the latch arm include vertically extending locking tabs which may be secured together in conventional fashion. The latch element is movable from a lowered position supported on the guide support upwardly into a locked position where it is held in position by a cable or padlock which extends through aligned openings provided in the projecting tabs of the lock mechanism.

DESCRIPTION OF THE PREFERRED EMBODIMENT

Figure 1:
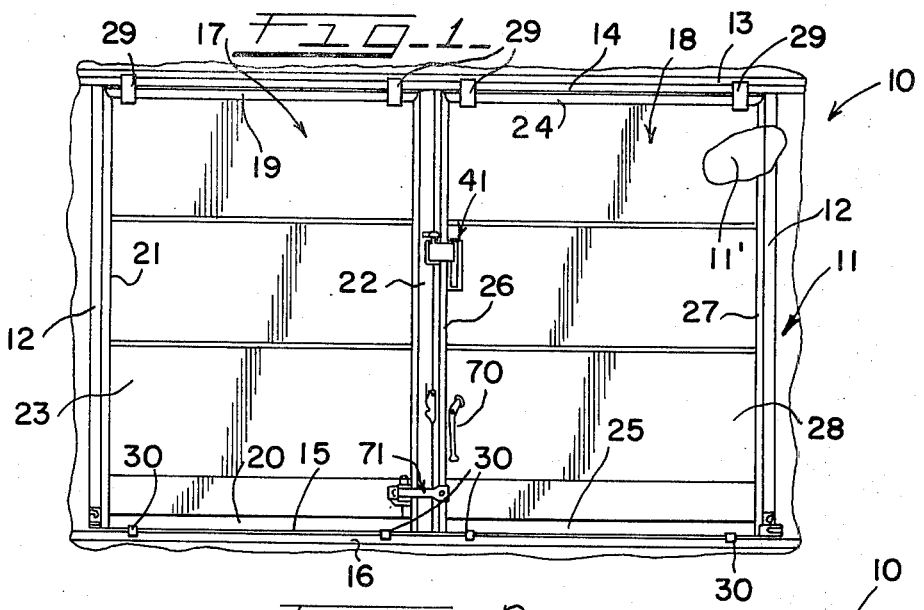
FIG. 1 is a side elevational view of a box car side having a door opening including a pair of sliding doors connected together by an improved locking mechanism.

Referring particularly to FIG. 1, a railway car body 10 includes sidewall sheathing 11 provided with a conventional door opening 11'. The door opening 11' is defined by horizontally spaced vertical door posts 12 connected at their upper ends by an upper header construction 13 and by a lower threshold construction 15. An upper track 14 is supported on the upper header construction 13 and a lower track 16 is supported on a lower threshold construction 15. A first side door 17 is supported within the opening 11' the same being conventionally termed as an auxiliary door and a second side door 18 is positioned adjacent thereto in connected relation. The side doors 17 and 18 are of the sliding type which are readily movable individually to opposite sides of the door opening. The auxiliary door 17 includes horizontal support frame members 19 and 20 connected by side vertical support frame members 21 and 22. The side door 17 is covered by door sheathing 23 of conventional construction. The door 18 also includes horizontal support frame members 24 and 25 in turn connected by side vertical support frame members 26 and 27 and also includes conventional door sheathing 28. Both of the doors 17 and 18 include conventional safety support hangers 29, the doors being supported for sliding movement on the upper track 14. The lower ends of the doors also include guides 30 of conventional design and rollers (not shown) for slidingly supporting the doors 17 and 18 on the lower track 16.

Figure 3:
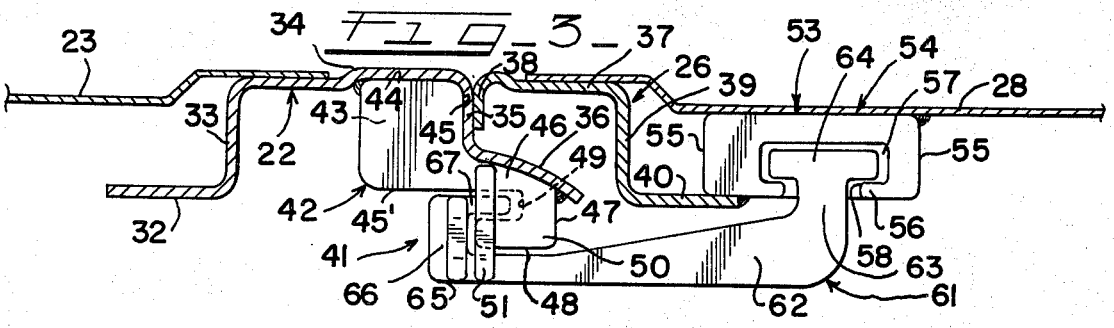
FIG. 3 is a cross sectional view taken substantially along the line 3—3 of FIG. 2.

The door 17 and vertical support frame member 22, as best shown in FIG. 3, includes an outer longitudinal flange 32 connected to an inwardly or laterally extending flange 33 which in turn is connected to a longitudinal base flange 34. The base flange 34 which extends the length of the doors includes an outwardly extending portion 35 having connected thereto an arcuate weather seal flange 36.

The vertical support frame member 26 also includes a longitudinal base flange 37 having a vertical seal edge portion 38 and a lateral flange 39 in turn connected to a longitudinal flange 40, spaced outwardly from the sheathing 28.

Figure 2:
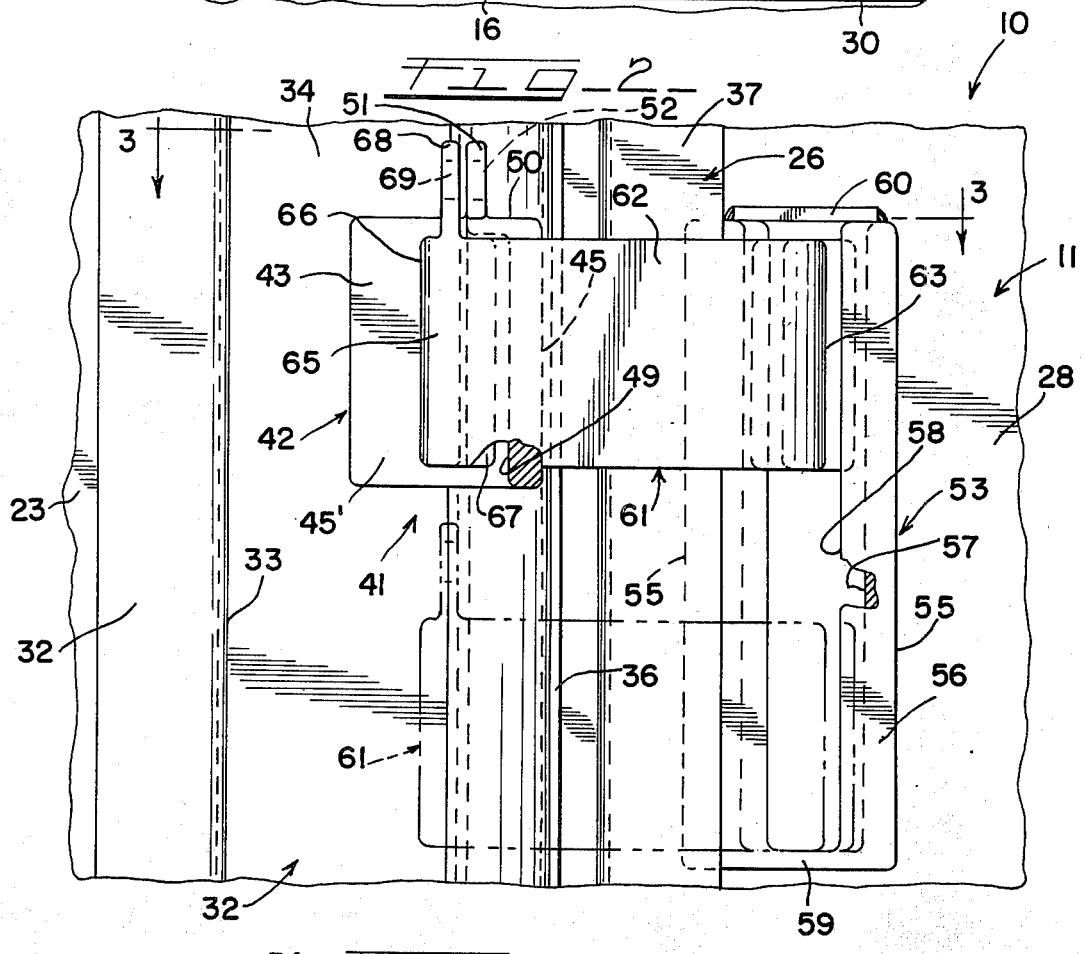
FIG. 2 is a side elevational view enlarged to disclose an improved locking mechanism.

An anti-pilferage lock mechanism designated at 41 is best shown in FIGS. 2 and 3, includes a keeper member 42. The keeper member may be formed of a casting and includes a base member 43 having vertical walls 44 and 45 and which are rigidly secured to the flanges 34 and 35. The base member 43 also includes an outer wall 45'. An arcuate extension 46 of the base member 43 is rigidly attached to the arcuate weather seal flange 36 and projects laterally outwardly with respect thereto. The extension 46 also includes a wall 47 extending perpendicular or normal to the door 17. The base member 43 also includes a wall 48 extending substantially parallel to the wall 45' and is connected to the wall 47. The walls 47 and 48 are disposed in hock shaped relation to provide a vertically extending recess 49 which extends longitudinally outwardly in a direction facing the flange 33. The longitudinal recess 49 extends vertically substantially the length of the keeper member 42 as best shown in FIG. 2. The base member also includes a top wall 50 enclosing the top of the recess 49. A locking tab 51 projects upwardly from the wall 50 as best indicated in FIGS. 2 and 3. The locking tab 51 includes an opening 52.

A latch support 53 is rigidly secured to the sheathing 28 to one side of the keeper 42. The latch support 53 includes an inner wall 54 suitably connected to the sheathing 28 and includes outwardly projecting side walls 55. An outer wall 56 connects the walls 55. The latch support 53 is of hollow construction to provide a vertical guideway 57 which opens outwardly by virtue of a vertically extending slot 58 formed in the wall 56. A bottom wall 59 closes the lower end of the guideway 57. A top closure member 60 closes the upper end of the vertical guideway 57.

A latching element 61, as best shown in FIGS. 2 and 3, includes a horizontal arm 62 having at one end a laterally extending portion 63 which projects through the slot 58. A rectangular slide member 64 is connected to the lateral end portion 63 so as to be disposed in the guideway 57 for relative vertical guided sliding movement.

The other end of the arm 62 is provided with an overlapping end portion 65 which extends beyond the wall 48 of the keeper 42. An inwardly or laterally extending wall portion 66 is connected to the overlapping end portion 65 and has connected thereto a tongue 67 which projects into the recess 49 and is substantially parallel with respect to the walls 45' and 48 and is engaged within the recess 49. The inwardly extending wall 66 of the overlapping end portion 65 also includes a vertically extending locking tab 68 having an opening 69 which is adapted to register with the opening 52 of the tab 51.

A closing and opening lever mechanism is generally designated at 70 in FIG. 1, the same being utilized to assist in opening and closing of the sliding doors relative to each other in conventional fashion and in a manner which is well known in the art. Similarly, the lower ends of the doors 17 and 18 are connected by a conventional hasp and lock arrangement 71.

THE OPERATION

In the present arrangement, two doors 17 and 18 are disclosed. These doors may slide apart individually to an open position or the door 18 may be moved with the door 17 remaining in position. In a single door arrangement the lock 41 would be mounted with the keeper on one of the frame members 12 and the arm 62 would be mounted on the single door. Assuming now that the operator wishes to open the door 18 when the box car has arrived at the loading dock the operating person on the dock can readily remove a cable (not shown) or padlock (not shown) from the openings 52 and 69 whereupon the latching element 61 quickly and easily drops down by gravity to its lower position on dotted lines in FIG. 2 where it comes to rest on the bottom wall 59. He then disengages the conventional hasp 71 and utilizes the door opening and closing lever mechanism 70 to pry the doors apart and then move door 17 laterally to one side of the door opening.

To close and lock the doors again in the position shown in FIG. 1, the reverse operation takes place. The operator secures the hasp lock 71 and then merely lifts the latching element 61 upwardly into position wherein the openings 52 and 69 are in registry and a padlock or cable can be inserted. The anti-pilferage is therefore again in locked position.

The anti-pilferage lock is applied to box car doors at a location approximately 10 feet above the rail level. This makes the lock relatively inaccessible to the person standing on the ground who has intentions to remove the lock without authority for reasons of pilferage. The anti-pilferage lock does not replace the primary and conventional hasp lock but is used as a secondary locking means on the door. Thus, the location of the anit-pilferage lock makes it very accessible to the person on a loading dock but relatively inaccessible to anyone standing on the ground.

The anti-pilferage lock disclosed can of course be applied to a single or double box car doors with little variation, as above described. One of the advantages of the anti-pilferage lock is that if it is not properly secured with some suitable restraining device, it falls open immediately by gravity and thus is immediately known to the authorized person inspecting the lock mechanisms. Further, it is readily apparent that when the anti-pilferage lock is unlocked it does not interfere with normal door operation.

What is claimed is:

1. In a railway car adapted for rolling on a railway track, said car having a body including a side wall provided with a door opening, and door means movable between open and closed positions. relative to said door opening, the improvement comprising;

a door lock mechanism mounted on said body at a vertical distance from said railway track substantially greater than the height of a person standing at track level beside said car to make the door lock mechanism substantially inaccessible to the person, said door lock mechanism connected to the door means for releasably holding the door means in a closed position and including a keeper having a base member supported on said body and projecting outwardly relative thereto, said base member including a vertically extending keeper recess open at its lower end, a latch support rigidly connected to said door means, said latch support being positioned at substantially the same height as said keeper, guide means on said latch support, a latching element having an arm extending horizontally from said latch support to said keeper, said latching element including a tongue portion in a lock position retained within said keeper recess to lock said door in a closed position, means connecting said latching element to said guide means to provide for guided vertical movement of said latching element relative to said keeper, and means on said latch support for supporting said latching element below said keeper whereby said latching element may be moved vertically between lock and unlock position relative to said keeper.

2. In a railway car having a body including a side wall provided with a door opening, door means movable between open and closed positions relative to said door opening, the improvement comprising;

a door lock mechanism including a keeper having a base member supported on said body and projecting outwardly relative thereto, said base member being positioned on said body adjacent said door opening remotely and vertically spaced from the lower portion of said door means so as to be substantially inaccessible to a person standing at track level beside said car, said base member including a vertically extending keeper recess open at its lower end, said keeper including a hook shaped portion containing said keeper recess, with said recess facing and opening in one longitudinal direction, a latch support rigidly connected to said door means, said latch support being positioned at substantially the same height as said keeper, guide means on said latch support, a latching element having an arm extending horizontally from said latch support to said keeper, said latching element including a tongue portion in a lock position retained within said keeper recess to lock said door in a closed position, said latching element including a hook shaped end portion to which said tongue is connected, said tongue extending in an opposite longitudinal direction and being slidingly engaged in said keeper recess, means connecting said latching element to said guide means to provide for guided vertical movement of said latching element relative to said keeper, and means on said latch support for supporting said latching element below said keeper whereby said latching element may be moved vertically between lock and unlock position relative to said keeper.

3. In a railway car having a body including a side wall provided with a door opening, door means movable between open and closed positions relative to said door opening, the improvement comprising;

a door lock mechanism including a keeper having a base member supported on said body and projecting outwardly relative thereto, said base member being positioned on said body adjacent said door opening remotely and vertically spaced from the lower portion of said door means so as to be substantially inaccessible to a person standing at track level beside said car, said base member including a vertically extending keeper recess open at its lower end, said keeper including a wall portion extending outwardly normal to said side wall, a second wall connected to said first wall and extending parallel to said side wall in a first longitudinal direction and defining said recess, a latch support rigidly connected to said door means, said latch support being positioned at substantially the same height as said keeper, guide means on said latch support, a latching element having an arm extending horizontally from said latch support to said keeper, said latching element including a tongue portion in a lock position retained within said keeper recess to lock said door in a closed position, means connecting said latching element to said guide means to provide for guided vertical movement of said latching element relative to said keeper, and means on said latch support for supporting said latching element below said keeper whereby said latching element may be moved vertically between lock and unlock position relative to said keeper.

4. The invention in accordance with claim 3, said latching element having an end portion overlapping said second wall, and an inwardly extending wall connected to said end portion and said tongue being connected to said inwardly extending wall, said tongue extending parallel to said second wall into said recess and in a second opposite longitudinal direction into a lock position.

5. The invention in accordance with claim 4, said keeper and said latching element including projecting tabs having lock openings, and said lock openings being in registry during the lock position of said keeper and latching element.

6. The invention in accordance with claim 1, said guide means on said latch support including a vertically extending slideway having an outer wall provided with an elongated slot opening into said slideway, and said latching element having at one end of said arm a projecting portion extending through said elongated slot, and a slide member connected to said arm end and slidingly supported in said slideway.

7. The invention in accordance with claim 1, said body including a second lock mechanism positioned below said first mechanism for locking said door, said second lock mechanism being located adjacent the lower end of said body so as to be readily accessible to a person standing at track level beside said car.

* * * * *